US007589949B2

(12) United States Patent
Salisbury

(10) Patent No.: US 7,589,949 B2
(45) Date of Patent: Sep. 15, 2009

(54) FLUID ASSISTED EMITTER TIP AND METHOD

(75) Inventor: Jeffrey M. Salisbury, Lakeville, MN (US)

(73) Assignee: Seagate Technology LLC, Scotts Valley, CA (US)

( * ) Notice: Subject to any disclaimer, the term of this patent is extended or adjusted under 35 U.S.C. 154(b) by 4 days.

(21) Appl. No.: 11/250,599

(22) Filed: Oct. 14, 2005

(65) Prior Publication Data

US 2007/0086142 A1 Apr. 19, 2007

(51) Int. Cl.
*H01T 23/00* (2006.01)

(52) U.S. Cl. ..... 361/231

(58) Field of Classification Search ..... 361/231
See application file for complete search history.

(56) References Cited

U.S. PATENT DOCUMENTS 3,308,344 A 3/1967 Smith et al.
3,643,128 A 2/1972 Testone
3,976,916 A 8/1976 Saurenman
4,007,576 A 2/1977 Metz
4,038,583 A 7/1977 Breton
4,168,973 A 9/1979 Simm et al.
4,188,530 A 2/1980 Miller
4,194,232 A 3/1980 Cumming et al.
4,198,061 A 4/1980 Dunn
4,213,167 A 7/1980 Cumming et al.
4,250,804 A 2/1981 Saurenman
4,271,451 A 6/1981 Metz
4,302,670 A 11/1981 Zaderej
4,318,028 A * 3/1982 Perel et al. ..... 315/111.81
4,319,302 A 3/1982 Moulden
4,326,454 A 4/1982 Saurenman
4,349,359 A 9/1982 Fitch et al.
4,388,274 A 6/1983 Rourke et al.
4,388,667 A 6/1983 Saurenman
4,390,923 A 6/1983 Saurenman
4,484,249 A 11/1984 Saurenman
4,498,116 A 2/1985 Saurenman
4,502,091 A 2/1985 Saurenman
4,502,093 A 2/1985 Saurenman
4,514,779 A 4/1985 Wilkinson
4,519,114 A 5/1985 Rhyne
4,523,082 A 6/1985 Sturdevant
4,528,612 A 7/1985 Spengler
4,596,585 A 6/1986 Moeller et al.
4,626,917 A 12/1986 Saurenman
4,725,731 A 2/1988 Lang
4,725,732 A 2/1988 Lang et al.
4,729,057 A 3/1988 Halleck
4,757,421 A 7/1988 Mykkanen
4,781,175 A * 11/1988 McGreevy et al. ..... 606/40
5,008,594 A 4/1991 Swanson et al.

(Continued)

*Primary Examiner*—Stephen W Jackson
*Assistant Examiner*—Scott Bauer
(74) *Attorney, Agent, or Firm*—Fellers, Snider, et al.

(57) ABSTRACT

An emitter tip for a corona discharge device. The emitter tip comprises an elongated body with a tapered end. The body defines a central passage and the tapered end defines a tip passage in fluid communication with the central passage. A method is provided for controlling electrostatic charge comprising providing a voltage source; providing a pressurized fluid source; connecting the emitter tip to the voltage source and to the fluid source; passing the fluid through the emitter tip; and electrically energizing the emitter tip.

19 Claims, 2 Drawing Sheets

U.S. PATENT DOCUMENTS 5,095,400 A * 3/1992 Saito ..... 361/220
5,116,583 A 5/1992 Batchelder et al.
5,121,286 A 6/1992 Collins
5,153,968 A 10/1992 Sterin et al.
5,229,819 A 7/1993 Beresniewicz et al.
5,241,449 A 8/1993 Moeller et al.
5,419,016 A 5/1995 Faas
5,432,670 A 7/1995 Batchelder et al.
5,478,328 A * 12/1995 Silverman et al. ..... 604/272
5,592,357 A 1/1997 Rader et al.
5,686,050 A 11/1997 Wadsworth et al.
5,726,447 A 3/1998 Aisawa et al.
5,895,558 A 4/1999 Spence
5,955,174 A 9/1999 Wadsworth et al.
6,059,935 A 5/2000 Spence
6,416,633 B1 7/2002 Spence
6,690,006 B2 * 2/2004 Valaskovic ..... 250/288
6,958,063 B1 * 10/2005 Soll et al. ..... 606/41
2003/0142455 A1 7/2003 Muz

* cited by examiner

FLUID ASSISTED EMITTER TIP AND METHOD

FIELD OF THE INVENTION

The embodiments of the present invention relate generally to the field of electrostatic charge control and more particularly without limitation to corona discharge emitter tips.

BACKGROUND

Corona discharge ionizer devices are commonly used for controlling the presence of electrostatic charge in manufacturing environments involving sensitive components, such as in the semiconductor and data storage device industries. Corona discharge ionizers employ a number of emitter tips that, when energized with a sufficiently high voltage, create a corona discharge. The corona discharge is an ion cloud having a charge established by the polarity of the voltage. In many cases a non-hydrogen fluid stream is passed over the emitter tips in order to direct and advance the ion stream in order to statically charge or discharge a work piece. However, problems exist in the current state and use of corona discharge ionizers.

One problem is the tendency for precipitating ammonium nitrate on the emitter tip. In order for the tip to effectively create the corona discharge, the emitter tip must remain clean, sharp, and electrically conductive. Such a buildup reduces the tip's effectiveness in creating the corona discharge. Regularly scheduling maintenance activities to clean or replace the emitter tips can be a costly and unworkable production interruption.

Another problem is associated with bursts of submicron particles coming from the emitter tips that can be introduced into the manufacturing environment. In some cases the contamination comes from sputtering of the material from which the emitter tip is manufactured; in other cases the contamination is particles of the ammonium nitrate precipitation.

While various approaches have been proposed in the art to address the contamination that can be introduced into the manufacturing process by emitter tips, there nevertheless remains a continued need for improvements in the art. It is to such improvements that the claimed invention is directed.

SUMMARY OF THE INVENTION

Embodiments of the present invention contemplate an emitter tip for a corona discharge device. The emitter tip comprises an elongated body with a tapered closed end. The body defines a central passage and the tapered end defines a medial tip passage in fluid communication with the central passage.

In some embodiments a method is provided for controlling electrostatic charge. The method comprises providing a voltage source; providing a pressurized fluid source; connecting the emitter tip to the voltage source and to the fluid source; passing the fluid through the emitter tip; and electrically energizing the emitter tip.

In other embodiments a corona discharge device is provided, comprising a voltage source connected to an emitter tip; and an arrangement for preparing a work piece for manufacturing by steps for controlling the electrostatic charge of the work piece. The steps for controlling is characterized by connecting a voltage source and a pressurized fluid source to the emitter tip, and by passing the pressurized fluid through the emitter tip while electrically energizing the emitter tip.

These and various other features and advantages which characterize the claimed invention will become apparent upon reading the following detailed description and upon reviewing the associated drawings.

DETAILED DESCRIPTION

Figure 1:
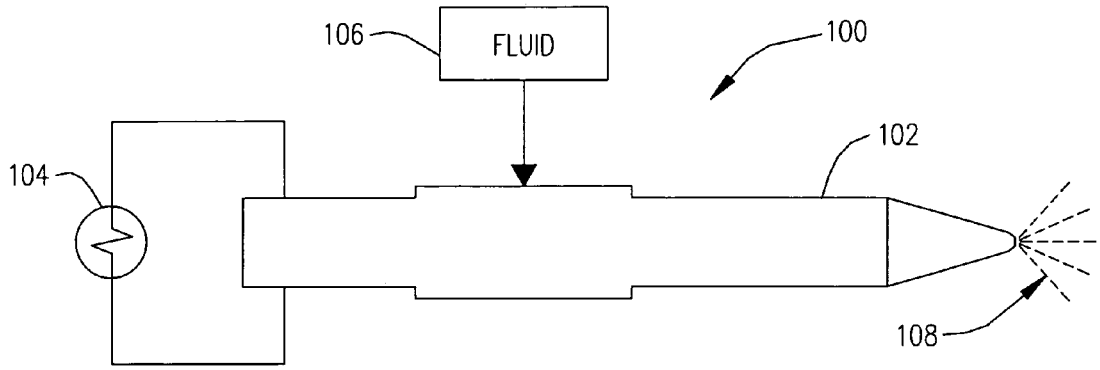
FIG. 1 is a diagrammatic view of a corona discharge device constructed in accordance with embodiments of the present invention.

FIG. 1 is a diagrammatic illustration of a corona discharge device 100 constructed in accordance with embodiments of the present invention. The device 100 comprises an emitter tip 102 that is electrically connectable to a high voltage source 104 and to a pressurized fluid source 106. The illustrative embodiments of FIG. 1 identify the voltage source 104 as being an alternating current type voltage source. In equivalent alternative embodiments the voltage source 104 can be a pulsed direct current voltage source, and preferably can be a direct current steady state voltage source. The voltage source 104 electrically energizes the tip 102 which, by way of its construction, emits a corona discharge 108 of electrically charged ions. The pressurized fluid 106 aids in protecting the emitter tip 102 from adverse deterioration and/or ammonium nitrate precipitation by delivering a supply of pressurized fluid into the emitter tip 102. The pressurized fluid 106 can also aid in propelling the ions toward a target object.

Figure 2:
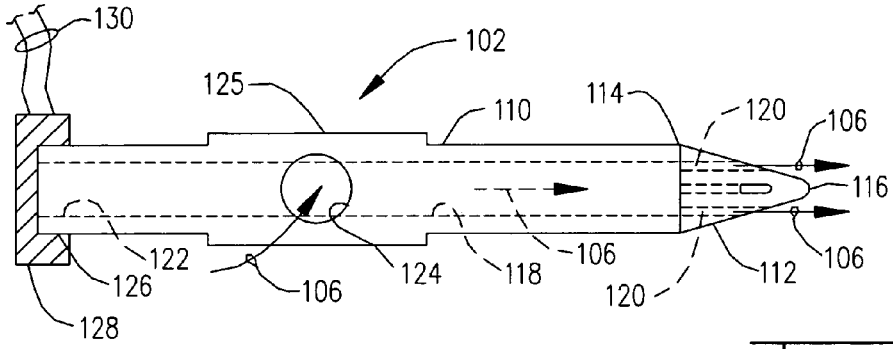
FIG. 2 is a side elevational view of an emitter tip of the corona discharge device of FIG. 1 constructed in accordance with embodiments of the present invention.

FIG. 2 is a side elevational view of the emitter tip 102, which generally comprises an elongated body 110 with a tapered portion 112. In the illustrative embodiments of FIG. 1, the body 110 defines a circular cross section with a diameter of about 0.100 inches. The tapered portion 112 is substantially contiguous with the body 110 at a proximal end 114 of the tapered portion 112, and can terminate in a sharp or a radiused tip at a distal end 116 of the tapered portion 112. In preferred embodiments the distal end 116 of the tapered portion 112 defines about a 0.003 inch radius. In the circular cross section embodiments of FIG. 2 the converging surface defining the tapered portion 112 is conical.

The body 110 defines a longitudinal central passage 118. The tapered end 112 defines one or more tip passages 120 passing through the tapered end 112 and in fluid communication with the central passage 118. In the illustrative embodiments of FIG. 2 the tip passage 120 has a bore diameter of about 0.01 inches. In this arrangement, pressurized fluid from the fluid source 106 (FIG. 1) can be delivered into the central passage 118 and expelled through the one or more tip passages 120.

The formation of ammonium nitrate is significantly reduced by passing an appropriate fluid through the tip passages 120 while electrically operating the emitter tip 102. Ammonium nitrate is a compound formed of nitrogen, hydrogen, and oxygen. Thus, a source of hydrogen is necessary to precipitate ammonium nitrate. One source of hydrogen is atmospheric water vapor. By flowing a sufficiently dry gas through the tip passage 120 and thereby onto the distal end 116 of the tapered portion 112, no ammonium nitrate can precipitate. Accordingly, the fluid source 106 can supply a pressurized and clean, non-hydrogen gas such as but not limited to dry air, oxygen, carbon dioxide, nitrogen, argon, or helium. It will be noted that passing the fluid from the fluid source 106 inside the emitter tip 102 rather than over it significantly reduces the volume of fluid that is necessary to prevent the unwanted precipitation.

In some embodiments (not shown), the pressurized fluid from the fluid source 106 (FIG. 1) can be connected by an appropriate conduit and connector arrangement attached to an open end 122 of the central passage 118. Alternatively, as shown in the embodiments of FIG. 2, the body 110 can define a transverse opening 124 in fluid communication with the central passage 118. A connector (not shown), such as a barbed fitting, can be attached to the opening 124 for attaching a conduit from the fluid source 106 (FIG. 1). It may be necessary, as illustrated in FIG. 2, to enlarge a portion 125 of the body 110 around the opening 124 in order to accommodate the fitting.

A connecting end 126 of the body 110, opposite the tapered end 112, is configured for electrically engaging a socket 128 which is, in turn, electrically connected to the high voltage source 104 (FIG. 1) by leads 130. In some embodiments illustrated in FIG. 2 the voltage source 104 provides a voltage in the range of about 2,000 to 15,000 volts.

In some embodiments illustrated by FIG. 2 the tip passage 120 is disposed substantially collinearly with the central passage 118. In other words, the tip passage 120 is disposed substantially transverse to a plane defined by the proximal end 114 of the tapered portion 112. Alternatively, in some embodiments (not shown), the tip passage 120 can be directed toward or away from the distal end 116 of the tapered portion 112. In any event, preferably the tip passage 120 intersects a medial portion of the tapered portion 112 between the proximal end 114 of the tapered portion 112 and the distal end 116 of the tapered portion 112, thereby preventing the tip passage 120 from interfering with the corona discharge formed at the sharp distal end 116 of the tapered portion 112.

Figure 3:
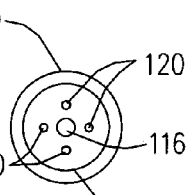
FIG. 3 is a front elevational view of the emitter tip of FIG. 2

FIG. 3 best illustrates embodiments contemplate two or more tip passages 120 in the tapered end 112. Preferably, the tip passages 120 are equidistantly arranged around the tapered end 112.

In some embodiments the emitter tip 102 can be machined from pin stock to the desired body 110 size and tapered end 112 configuration. A drilling operation can be used to manufacture the central passage 118, and an electrodischarge machining (EDM) operation can be used to manufacture the tip passage 120.

Figure 4:
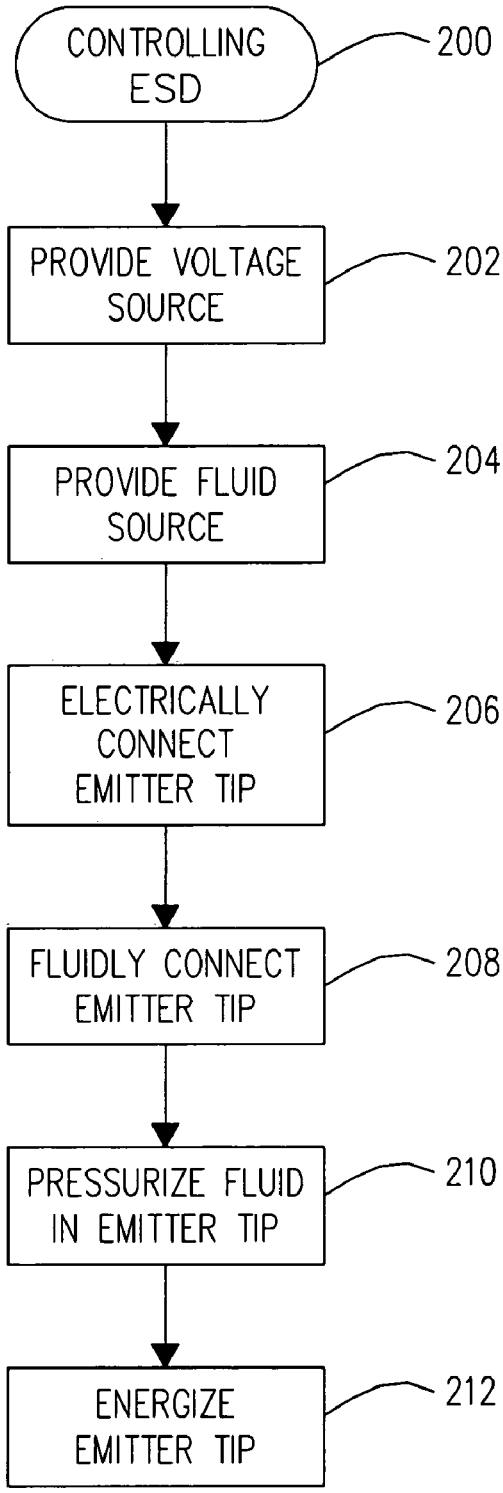
FIG. 4 is a block diagram of a method for controlling electrostatic charge illustrating steps for practicing the embodiments of the present invention.

FIG. 4 is a block diagram of a method 200 for CONTROLLING ELECTROSTATIC CHARGE illustrating steps for carrying out the embodiments of the present invention with the apparatus discussed above. The method begins at step 202 by providing the voltage source 104, which includes providing the electrical connector 128 for electrically engaging the emitter tip 102, and providing the interconnecting leads 130. The method continues at step 204 by providing the fluid source 106, which includes providing the fluid connector (not shown), such as for attachment in the opening 124, and providing the interconnecting conduit (not shown).

In step 206 the emitter tip 102 is electrically connected to the voltage source 104. In step 208 the emitter tip 102 is fluidly connected to the fluid source 106. The method then provides pressurized fluid to the emitter tip 102 at step 210, and finally electrically energizes the emitter tip at step 212.

Figure 5:
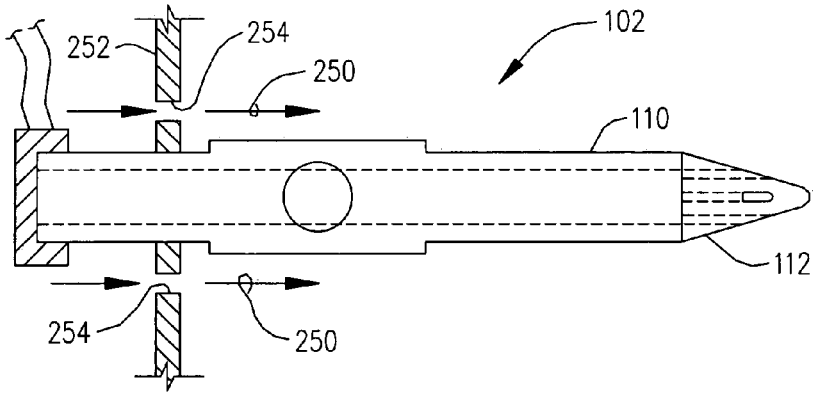
FIG. 5 is a side elevational view of the emitter tip of FIG. 2 utilized in accordance with alternative embodiments of the corona discharge device of FIG. 1.

FIG. 5 is a side elevational view of the emitter tip 102 utilized in accordance with alternative embodiments of the corona discharge device of FIG. 1. Here, in addition to the fluid from the fluid source 106 (FIG. 1) flowing inside the emitter tip 102, an additional fluid flow 250 is provided in order to further advance the ionized particles toward a work piece (not shown). The fluid flow 250 can be directed around the emitter tip 102 by a dielectric partition 252 that defines one or more openings 254 for passing the fluid flow 250.

Summarizing generally, an emitter tip (such as 102) is provided for a corona discharge device (such as 100). The emitter tip comprises an elongated body (such as 110) with a closed tapered end (such as 112). The body defines a central passage (such as 118) and the tapered end defines a tip passage (such as 120) in fluid communication with the central passage.

The body defines a characteristic size, and the tapered end is substantially contiguous with the body at a proximal end of the tapered portion (such as 114), and terminates in a sharp or radiused tip portion at a distal end of the tapered portion (such as 116). In some embodiments the body is circular and the converging surface defining the tapered portion is conical.

The tip passage is disposed substantially transverse to a plane defined by the tapered portion. The tip passage is disposed at a medial portion of the tapered portion between the proximal and distal ends. Preferably, the tapered portion comprises two or more tip passages which are equidistantly arranged around a longitudinal axis.

In some embodiments a method for controlling electrostatic charge is provided, comprising providing a voltage source; providing a pressurized fluid source; providing a corona discharge emitter tip; connecting the emitter tip to the voltage source and to the fluid source; passing the fluid through the emitter tip; and electrically energizing the emitter tip.

In some embodiments the providing a corona discharge emitter tip step comprises forming the emitter tip as comprising an elongated body with a tapered end, the body defining a central passage and the tapered end defining a tip passage in fluid communication with the central passage.

In some embodiments the providing a corona discharge emitter tip comprises forming the body with an outer surface defining a characteristic size, and foaming the tapered portion at a proximal end thereof as being substantially contiguous with the outer surface, and terminating the tapered portion at a distal end thereof as a sharp or radiused tip portion. The outer surface can be circular and the converging surface defining the tapered portion accordingly can be conical.

In some embodiments the providing a corona discharge emitter tip comprises disposing the tip passage substantially transverse to a plane defined by the proximal end of the tapered portion. The tip passage is preferably disposed at a medial portion of the tapered portion between the proximal and distal ends. The emitter tip can comprise disposing two or more tip passages in the tapered portion, wherein the tip passages are arranged equidistantly around a longitudinal axis.

In some embodiments a corona discharge ionizer device is provided, comprising a voltage source connected to a corona ionizer emitter tip; and steps for controlling contamination operably created on the emitter tip by the voltage source. The steps for controlling are characterized by connecting a voltage source and a pressurized fluid source to the emitter tip.

The steps for controlling are further characterized by passing the pressurized fluid through the tip while electrically energizing the tip.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary depending on the particular configuration and arrangement of the emitter tip body and tapered end portions without departing from the spirit and scope of the present invention.

What is claimed is:

1. An emitter tip for a corona discharge device, the tip comprising a longitudinally extending electrically conductive body having a tapered portion, the tapered portion defined by a converging surface extending from a proximal end of the tapered portion to a closed distal end of the tapered portion, the body further defining an internal passage intersecting the converging surface at a medial location between the proximal and distal ends of the tapered portion at which the converging surface is non-parallel to the longitudinal axis.

2. The emitter tip of claim 1 wherein the body comprises an outer surface defining a characteristic size, and wherein the converging surface is characteristically the same size as the outer surface at the proximal end.

3. The emitter tip of claim 1 wherein the converging surface is conical.

4. The emitter tip of claim 1 wherein the passage is disposed substantially transverse to a lateral cross sectional plane of the tapered portion.

5. The emitter tip of claim 2 wherein the converging surface defines a substantially sharp point at the distal end.

6. The emitter tip of claim 1 comprising two or more passages intersecting the converging surface medially between the proximal and distal ends of the tapered portion.

7. The emitter tip of claim 6 wherein the passages are equidistantly arranged around a longitudinal axis.

8. The device of claim 1 comprising an external passage around the body.

9. The device of claim 8 wherein the external passage is defined by a dielectric material adjacent the body.

10. A method for controlling electrostatic charge comprising:

obtaining a corona discharge emitter tip having a longitudinally extending electrically conductive body having a tapered portion, the tapered portion defined by a converging surface extending from a proximal end of the tapered portion to a closed distal end of the tapered portion, the body further defining an internal passage intersecting the converging surface at a medial location between the proximal and distal ends of the tapered portion at which the converging surface is non-parallel to the longitudinal axis;

connecting the emitter tip to a voltage source; and passing a fluid through the internal passage.

11. The method of claim 10 wherein the obtaining a corona discharge emitter tip step is characterized by an outer surface of the body being substantially the same size as the converging surface at the proximal end of the tapered portion.

12. The method of claim 10 wherein the obtaining a corona discharge emitter tip step is characterized by the converging surface being conical.

13. The method of claim 10 wherein the obtaining a corona discharge emitter tip step is characterized by the passage being disposed substantially transverse to a lateral cross sectional plane of the tapered portion.

14. The method of claim 11 wherein the obtaining a corona discharge emitter tip step is characterized by the converging surface defining a substantially sharp point at the distal end.

15. The method of claim 10 wherein the obtaining a corona discharge emitter tip step is characterized by two or more passages intersecting the converging surface medially between the proximal and distal ends of the tapered portion.

16. The method of claim 15 wherein the obtaining a corona discharge emitter tip step is characterized by arranging the passages equidistantly around a longitudinal axis.

17. The method of claim 10 wherein the obtaining a corona discharge emitter tip step comprises forming an external passage around the body.

18. The method of claim 17 wherein the obtaining a corona discharge emitter tip step is characterized by a dielectric member defining the external passage.

19. The method of claim 17 comprising simultaneously passing a fluid through the external passage during the passing a fluid through the internal passage step.

* * * * *

UNITED STATES PATENT AND TRADEMARK OFFICE

CERTIFICATE OF CORRECTION

PATENT NO. : 7,589,949 B2
APPLICATION NO. : 11/250599
DATED : September 15, 2009
INVENTOR(S) : Jeffrey M. Salisbury It is certified that error appears in the above-identified patent and that said Letters Patent is hereby corrected as shown below:

In Col. 4, line 40
replace "In some embodiments the"
with "The"

In Col. 4, line 43
replace "defining a tip"
with "defining a medial tip"

In Col. 5, line 21
replace "portion, the tapered portion defined"
with "portion, defined"

In Col. 5, line 27
replace "axis."
with "axis and the body further having an enlarged portion defining an opening in fluid communication with the internal passage and oriented for admitting a fluid substantially transverse to the internal passage."

In Col. 6, line 12
replace "axis;"
with "axis and the body further having an enlarged portion defining an opening in fluid communication with the internal passage and oriented for admitting a fluid substantially transverse to the internal passage;"

UNITED STATES PATENT AND TRADEMARK OFFICE

CERTIFICATE OF CORRECTION

PATENT NO. : 7,589,949 B2
APPLICATION NO. : 11/250599
DATED : September 15, 2009
INVENTOR(S) : Jeffrey M. Salisbury It is certified that error appears in the above-identified patent and that said Letters Patent is hereby corrected as shown below:

In Col. 6, line 14
replace "passing a"
with "passing the"

Signed and Sealed this

Twenty-fourth Day of November, 2009

David J. Kappos

David J. Kappos
*Director of the United States Patent and Trademark Office*